United States Patent [19]

Munker

[11] 3,981,128

[45] Sept. 21, 1976

[54] MECHANISM FOR TRANSPORTING A YARN END IN A TEXTILE MACHINE

[75] Inventor: Gert Munker, Krefeld, Germany

[73] Assignee: Palitex Project-Company G.m.b.H., Dusseldorf, Oberkassel, Germany

[22] Filed: June 26, 1975

[21] Appl. No.: 590,429

[30] Foreign Application Priority Data

July 29, 1974 Germany ..... 2436433

[52] U.S. Cl. ..... 57/34 R; 57/58.7; 57/106; 226/97; 242/35.6 R

[51] Int. Cl.[2] ..... D01H 15/00; D01H 1/10; D01H 7/86

[58] Field of Search ..... 57/34 R, 58.7, 106, 57/34 B, 34.5; 226/97, 7; 28/1.4, 72.12; 242/35.6 R, 35.6 E

[56] References Cited

UNITED STATES PATENTS

| | | | |
|---|---|---|---|
| 2,715,308 | 8/1955 | Soussloff et al. | 57/58.7 X |
| 3,077,311 | 2/1963 | Furst | 242/35.6 |
| 3,128,590 | 4/1964 | Escursell-Prat | 57/34 R |
| 3,319,410 | 5/1967 | Franzen | 57/34 R |
| 3,478,504 | 11/1969 | Nimtz et al. | 57/34 R |
| 3,731,478 | 5/1973 | Franzen | 57/58.7 |

FOREIGN PATENTS OR APPLICATIONS

| | | |
|---|---|---|
| 487,458 | 6/1938 | United Kingdom |

*Primary Examiner*—John Petrakes
*Attorney, Agent, or Firm*—Bell, Seltzer, Park & Gibson

[57] ABSTRACT

A mechanism for use in a textile machine for transporting along a predetermined desired path of travel an end of a continuous yarn or the like, as follows. An elongate tube extends along and conforms to the contour of the predetermined desired path of travel of the yarn end. A freely displaceable piston is positioned within the hollow interior of the tube for movement within the tube along the length thereof. Selectively operable pneumatic devices are connected with the hollow interior of the tube for selectively moving the piston from one end to the other end thereof. A freely slidable, ring-like member is positioned at least partially around the outside of the tube and is magnetically coupled with the piston through the tube for movement along the length of the tube. A gripper device is carried by the ring-like member for holding and carrying the yarn end during selective movement of the ring-like member along the tube for transporting the yarn end along the predetermined desired path of travel. The mechanism is particularly useful with a two-for-one twister textile yarn processing machine and may be mounted at each spindle assembly thereof or may be carried by a movable carriage which is selectively moved to a desired spindle assembly location.

28 Claims, 11 Drawing Figures

MECHANISM FOR TRANSPORTING A YARN END IN A TEXTILE MACHINE

This invention relates to a mechanism for use in a textile machine, particularly a twister, spinning frame or the like yarn processing machine, for transporting along a predetermined path of travel a continuous yarn or the like for use in piercing-up of yarn ends occuring upon breaking of the yarn or for start-up of the yarn processing operation.

BACKGROUND OF THE INVENTION

In textile machines there frequently exists a requirement for causing the free end of a yarn, thread, strand or the like (hereinafter) collectively referred to as "yarn") being withdrawn from a bobbin or supply package to describe or be transported along a predetermined path of travel during threading-up of the textile machine in preparation for start-up thereof or during piecing-up of broken or otherwise separated yarn ends occuring during operation of the machine for knotting of the yarn end to another yarn end or for positioning the yarn end for winding onto a take-up package for allowing further textile machine operation.

Heretofore, it has been the usual practice to manually thread or transport the end of a continuous yarn in such textile machines from one point to another point for piecing-up or start-up of the textile machine. However, apparatus and methods have been proposed for transporting the yarn end within a slotted suction duct, as set forth in Federal German patent specification No. 1,685,932. Also, it has previously been proposed to convey the yarn end along a desired path of travel by a gripping mechanism, see British patent specification No. 487,458. However, these previous apparatuses and methods have not been entirely satisfactory from the standpoint of speed in transporting the yarn end, complicated designs of the mechanical apparatus requiring a great mechanical output, and limitations in the contour of the path of travel in which the yarn end may be transported.

OBJECTS AND SUMMARY OF THE INVENTION

Accordingly, it is the object of this invention to provide an improved mechanism for use in textile machine for transporting along a predetermined desired path of travel an end of a continuous yarn or the like.

It is a further object of this invention to provide such a mechanism which will transport the yarn end at a very fast rate with a small mechanical output and which can transport the yarn end along varied desired paths of travel.

It is a still further object of this invention to provide such a mechanism specifically in combination with a textile yarn processing machine, preferably a two-for-one twister yarn processing machine.

It has been found by this invention that the above objects may be accomplished by providing such a mechanism, as follows.

An elongate tube extends along and conforms to the contour of the predetermined desired path of travel of the yarn end and defines a hollow interior therewithin. A freely displaceable piston is positioned within the hollow interior of the tube for movement within the tube along the length thereof. Selectively operable pneumatic means are connected with the hollow interior of the tube for selectively moving the piston from one end to the other end thereof. A freely slideable, ring-like member is positioned at least partially around the outside of the tube for movement on the tube along the length thereof. Means magnetically couple the piston and the ring-like member through the tube for movement of the ring-like member with the piston. Gripper means are carried by the ring-like member for holding the yarn end during selective movement by the pneumatic means of the piston and the ring-like member along the tube for transporting the yarn end along the predetermined desired path of travel.

The above described mechanism may be utilized in any desired textile machine and particularly in textile yarn processing machines of the upward winding type in which a yarn is withdrawn from a supply package and travels along a path of travel upwardly to a take-up mechanism for winding a package of the processed yarn, such as a two-for-one twister textile yarn processing machine. With this type of machine, the mechanism of this invention may be positioned at each spindle assembly location of the machine or the mechanism may be carried by a portable carriage mounted for movement along the spindle assemblies of the textile machine for selective positioning at a desired spindle assembly.

Preferably, the mechanism includes selectively operable actuating means positioned adjacent at least one end of the tube for selectively operating the gripper means when the gripper means is positioned at the at least one end of the tube.

Other specific preferred and alternate features may be seen from the following more detailed description of the preferred embodiments of the present invention.

BRIEF DESCRIPTION OF THE DRAWINGS

Some of the objects and advantages of this invention having been set forth, other objects and advantages will appear when taken in conjunction with the accompanying drawings, in which.

DESCRIPTION OF PREFERRED EMBODIMENTS

Figure 1:
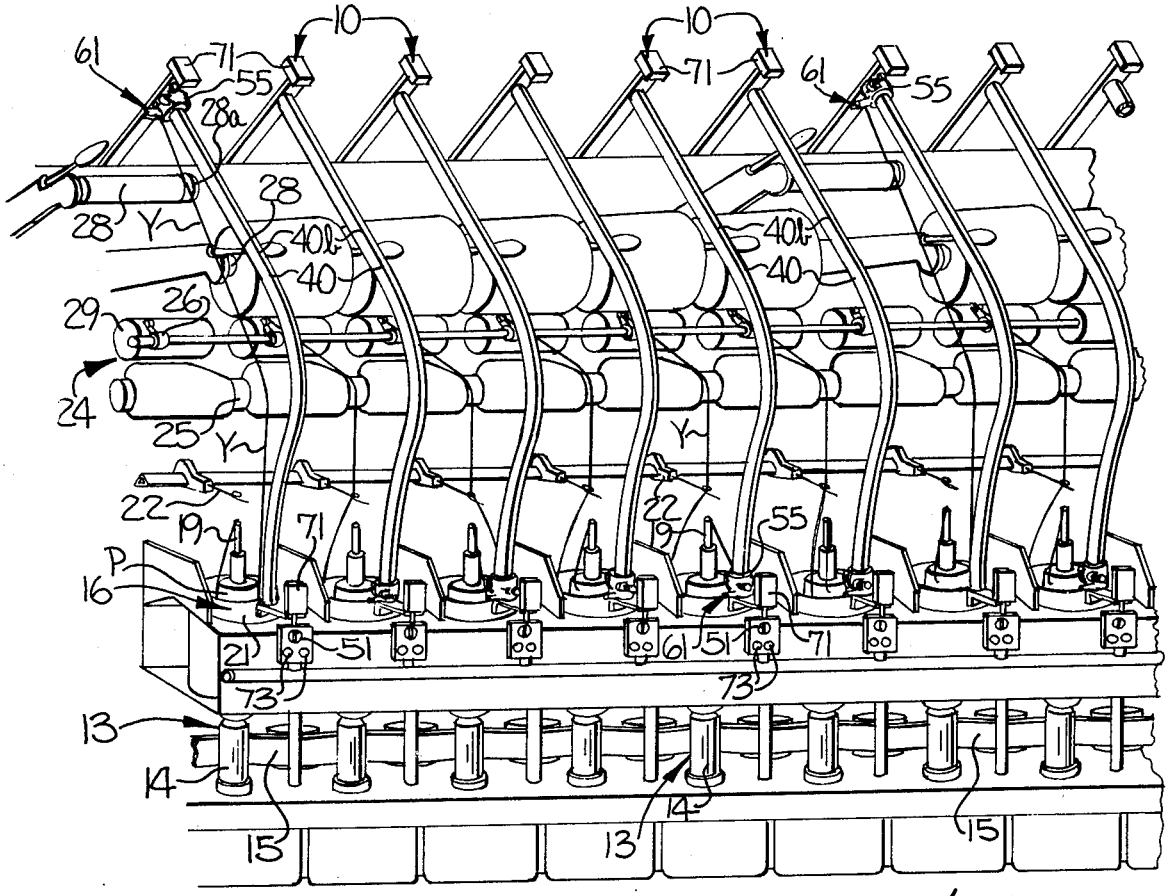
FIG. 1 is a partial perspective view of one side of a two-for-one twister textile yarn processing machine utilizing the mechanism of this invention positioned at each of the spindle assemblies thereon.
Figure 4:
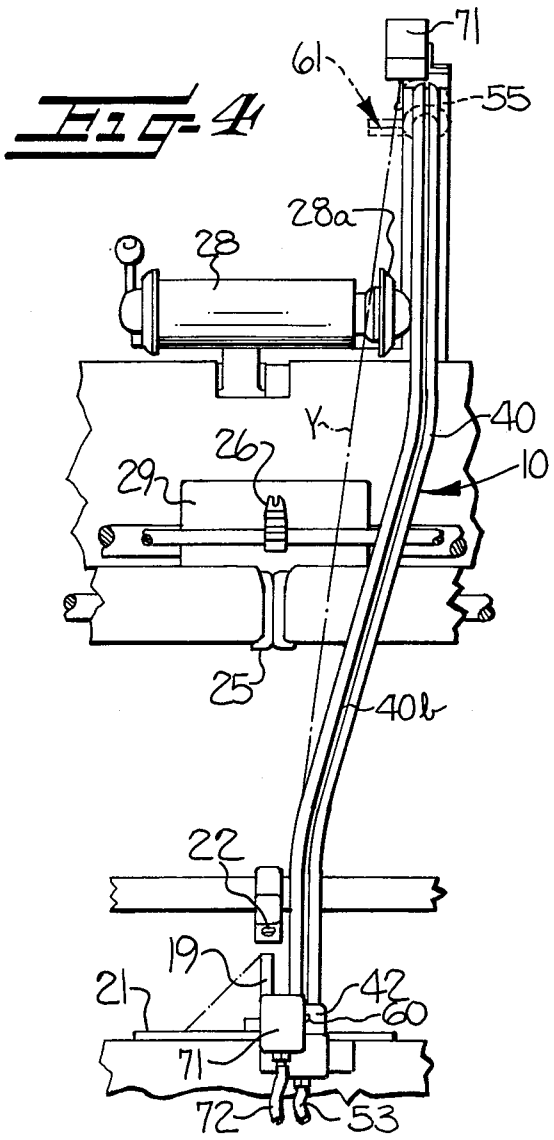
FIG. 4 is a front elevational view of the spindle assembly of FIG. 3.
Figure 3:
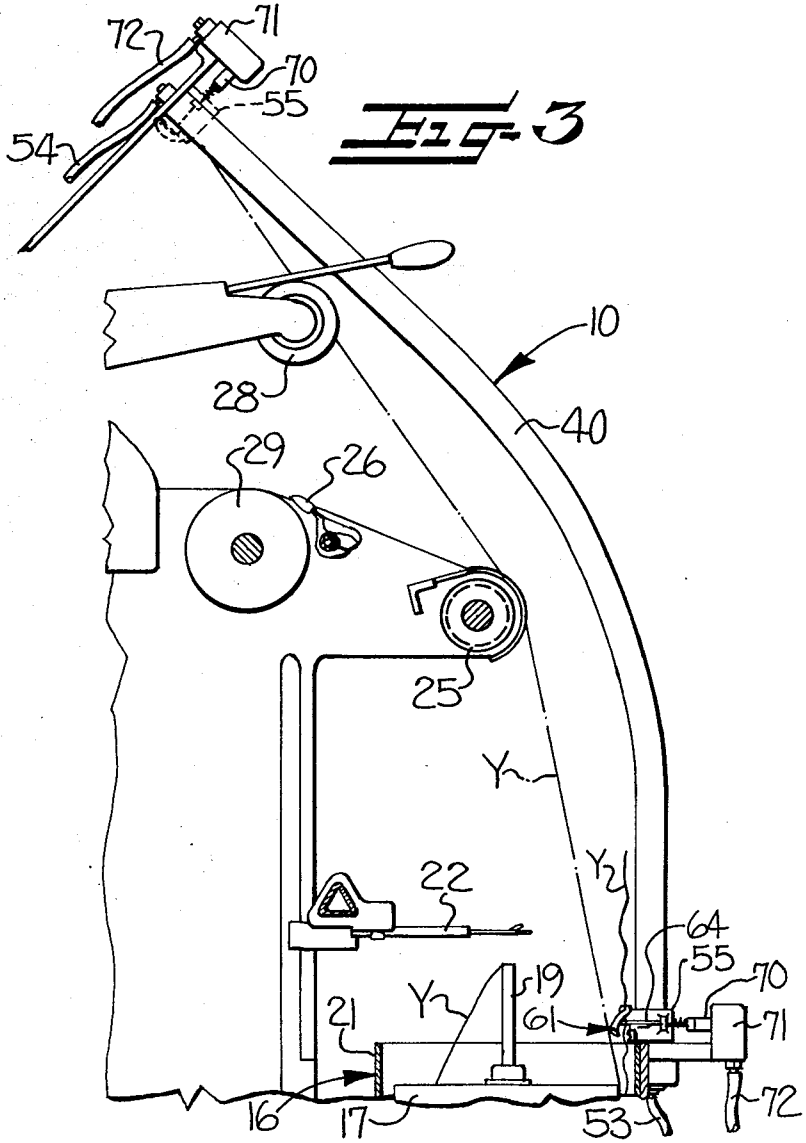
FIG. 3 is an enlarged, partial, cross-sectional, side, elevational view of a portion of one of the spindle assemblies of FIG. 1 with the mechanism of this invention thereon.
Figure 10:
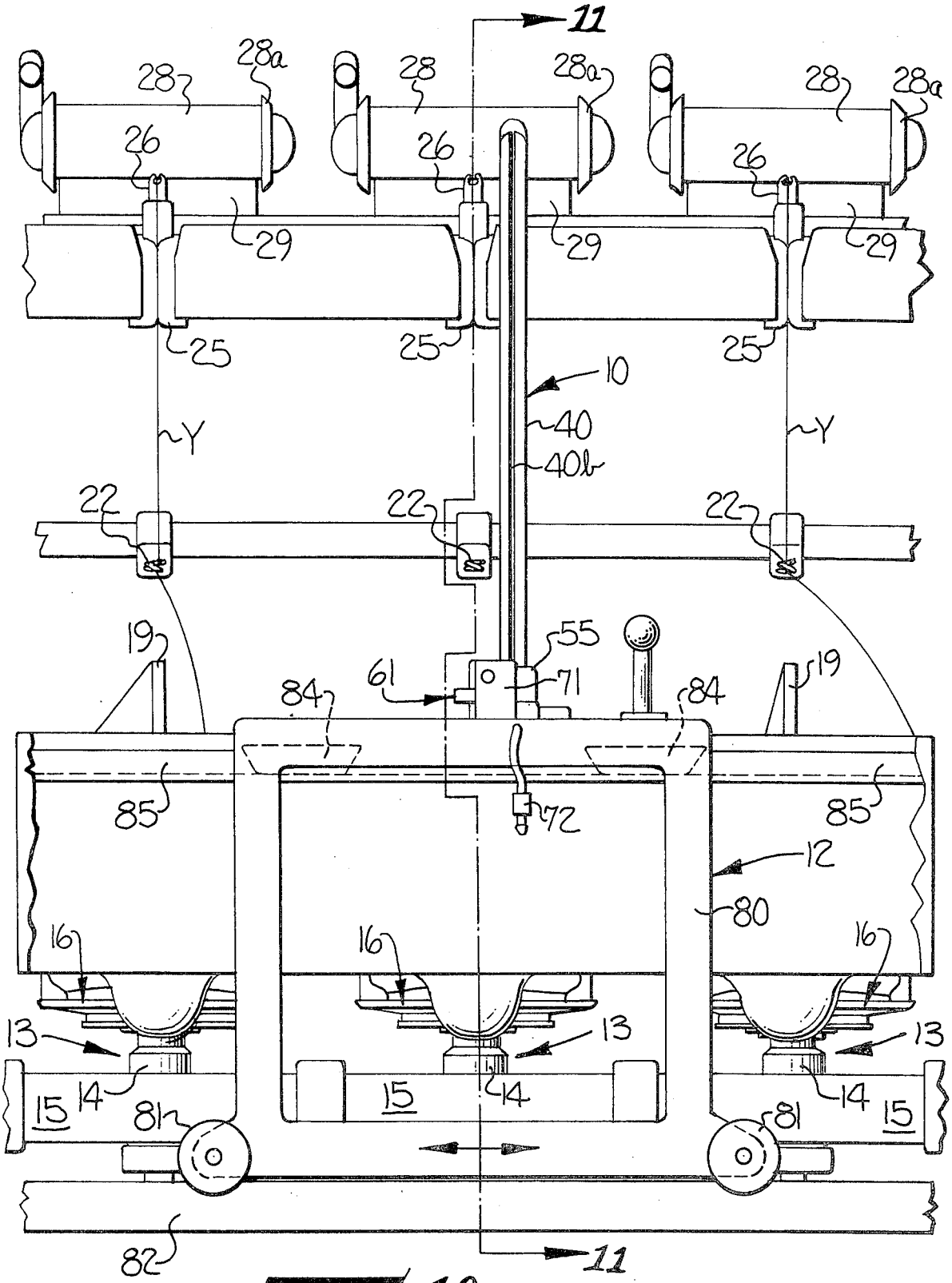
FIG. 10 is an enlarged, front plan view of three spindle assemblies of a two-for-one twister textile yarn processing machine utilizing the mechanism of this invention carried by a portable carriage for movement along the spindle assemblies.
Figure 11:
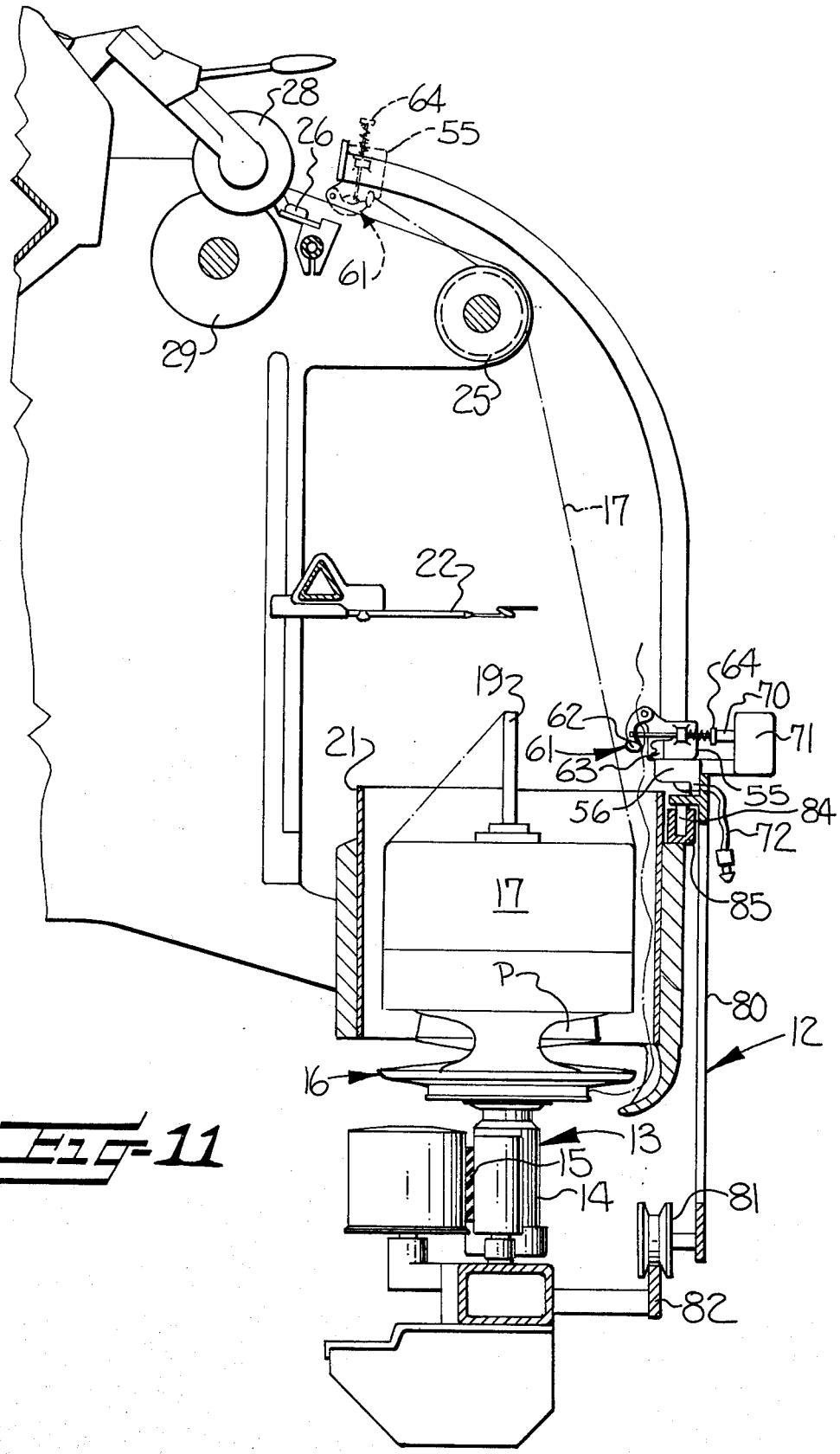
FIG. 11 is a cross-sectional, elevational view, taken generally along the line 11—11 of FIG. 10.

Referring now to the drawings, the improved mechanism of this invention is collectively indicated by the reference numeral 10. In FIGS. 1, 3 and 4, the improved mechanism 10 is illustrated as being attached to a two-for-one twister textile yarn processing machine and specifically at each of the spindle assembly stations on such twister. Conventionally, such a two-for-one twister textile yarn processing machine includes a plurality of spindle assembly stations disposed in side-by-side arrangement (as shown in FIG. 1) on each side of the machine (only one side of the machine being illustrated in FIG. 1). In FIGS. 10 and 11, the improved mechanism 10 of this invention is illustrated as being mounted on a portable carriage mechanism 12 mounted on the two-for-one twister textile yarn processing machine for movement in generally a horizontal direction along the front of the side-by-side spindle assembly stations for selective positioning in front of a desired spindle assembly station.

While the improved mechanism 10 of this invention, as indicated above, is specifically illustrated in the drawings for use with a two-for-one twister textile yarn processing machine, it is to be understood that the improved mechanism of this invention has utility and may be used with any textile machine in which a yarn, thread, strand or the like is desired to be transported from one location to another along a predetermined path of travel for assisting in threading-up or piecingup of the yarn for continued machine operation.

The spindle assembly stations of two-for-one twister textile yarn processing machines include a rotatably driven rotor mechanism 13 including a whorl 14 suitable rotatably mounted on the twister frame portion and rotated by a continuous drive belt 15.

The spindle assembly station further includes a yarn carrier mechanism 16 for carrying a hollow package P of yarn Y and being rotatably mounted on the rotor mechanism 13 so that the rotor mechanism may rotate relative thereto. The carrier mechanism 16 includes a basket device 17 which surrounds the package P of yarn Y and is rotatably mounted on the rotor mechanism 13 so that the rotor mechanism 13 may rotate relative thereto. The carrier mechanism 16 further includes a yarn entry tube 19 which provides a passageway for receipt of the yarn Y being withdrawn from the package P and which communicates with an internal passageway through and out of the carrier mechanism 16 and rotor device 13.

The spindle assembly 10 further includes a balloon limitor 21 surrounding the basket device 17 so that the yarn passes upwardly between the basket device 17 and the balloon limitor 21 and to a pigtail yarn guide 22 positioned above the yarn entry tube 19.

During passage of the yarn Y in the above-described path during yarn processing, a two-for-one twist is inserted into the yarn Y in a manner well understood by those with ordinary skill in the art.

The spindle assembly station further includes a take-up roll mechanism, generally indicated at 24, including a pre-takeup roll 25, a yarn traversing mechanism 26, and a friction driven, take-up or package roll 28 upon which the yarn Y is wound in a well understood manner after being processed. The takeup roll 28 is pivotally mounted for movement between a position in which the package being wound thereon is in frictional engagement with friction drive rolls 29 to an upper threading position (see FIG. 3) for threading up of the yarn Y upon start-up of a new package of yarn on the take-up roll 28, both positions being shown in FIG. 1. The take-up roll 28 includes outer disc-shaped members 28a which move outwardly upon the roll 28 being pivoted to the upper position and move inwardly upon the roll 28 being pivoted to the downward position for clamping the yarn end Y therein, as indicated in FIG. 4.

The operation of the above-described two-for-one twister textile yarn processing machine is well understood by those with ordinary skill in the art and further details of the construction and operation are not deemed necessary for an understanding of the present invention.

Referring now to the mechanism 10 of this invention, this mechanism 10 comprises an elongate tube 40 which (as shown in FIG. 1) is attached to the yarn processing machine frame at each spindle assembly station. The elongate tube 40 conforms to the contour of the predetermined desired path of travel for the yarn end Y and defines a hollow interior **40*a* therewithin. The tube 40 may be constructed of any non-magnetic material and by appropriate curving and lengthening thereof may form any suitable predetermined path of travel for the yarn end Y limited only by the flexual strength of the tube which may be virtually unlimited by providing intermediate supports for mounting of the tube. Accordingly, the tube 12 may form practically any desired path of travel for a yarn end in any textile machine including the two-for-one twister textile yarn processing machine illustrated in FIG. 1**.

The mechanism 10 further includes a freely displaceable piston 42 positioned within the hollow interior **40*a* of the tube 40 for movement within the tube 40** along the length thereof.

Selectively operable pneumatic means are connected with the hollow interior of the tube for selectively moving the piston 42 from one end to the other end of the tube 40. This selectively operable pneumatic means may comprise a source of compressed air connected with one or both ends of the tube 40 for supplying compressed air on one or both sides of the piston 42 for moving of the piston from one end of the tube 40 to the other end of the tube 40. Also, the pneumatic means may include a source of suction connected to one or both ends of the tube 40 for creating a suction within the hollow interior **40*a* of the tube 40 on one or both sides of the piston 42 for moving the piston from one end to the other end of the tube 40. If the tube 40 is positioned in a generally vertically extending position, the pneumatic means may include a source of compressed air connected with the bottom end of the tube 40 only or a source of suction connected with the top end of the tube 40 only and the piston 42 can move from the top to the bottom of the tube 40 under the influence of gravity. The pneumatic means for selectively moving the piston 42 will also include suitable selectively operable valve means connected with the compressed air source or the suction source for selectively controlling the flow of and the venting of compressed air or the creation of a suction within the hollow interior 40a of the tube 40.**

Figure 2:
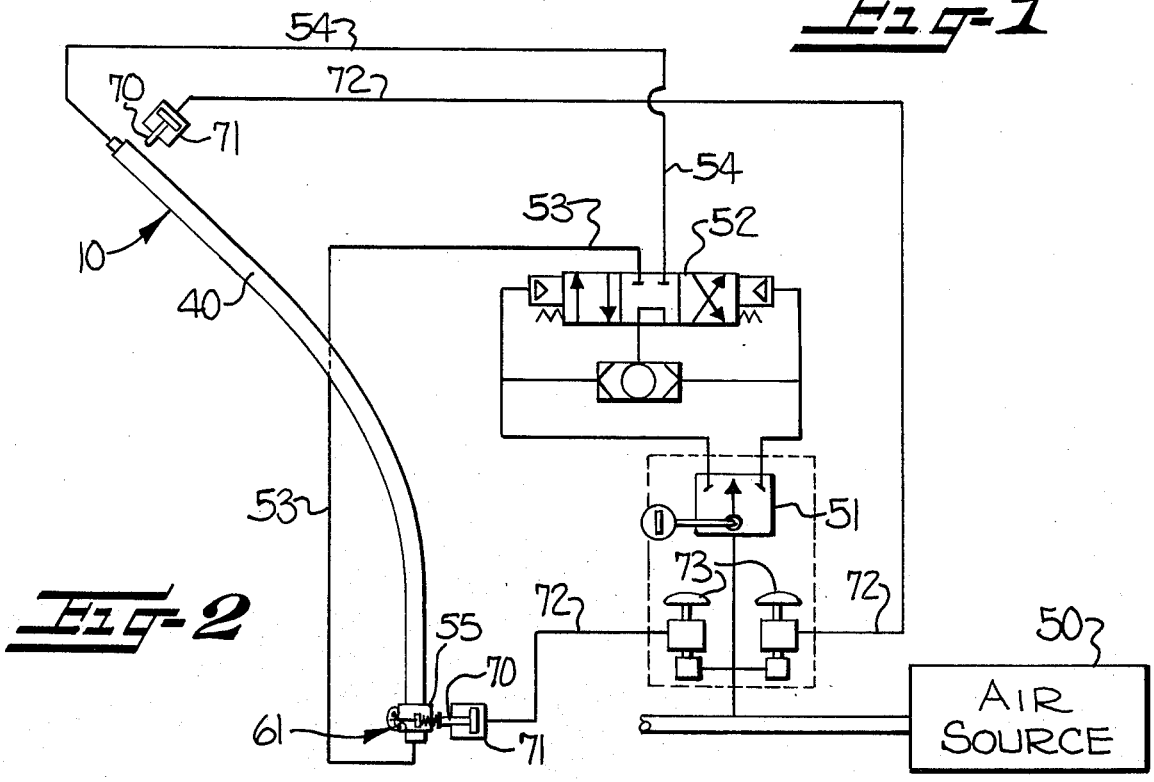
FIG. 2 is a schematic air circuit diagram of a pneumatic system which may be utilized with the mechanism of this invention.

By way of example, a suitable pneumatic air circuit is illustrated in FIG. 2 and may comprise a source of air under pressure 50 which supplies compressed air to a manually operated three-way valve 51 which may be selectively operated to supply the compressed air to either side of an "or" valve device for allowing the flow of compressed air through a pneumatically operated four-way valve 52 to in turn supply compressed air selectively through conduits 53, 54 to either side of the piston 42 within the hollow tube 40. The conduits 53, 54 are connected to the interior 40a of the tube 40 through suitable stopper devices 56, 57 disposed in the respective ends of the tube 40. The operation of an air circuit, such as diagramatically illustrated in FIG. 2, is well understood by those with ordinary skill in the art and further detailed explanation of the operation thereof is not deemed necessary herein. Suffice it to say that compressed air may be selectively supplied to either side of the hollow tube 40 for moving the piston 42 between the ends of the tube 40.

Figure 5:
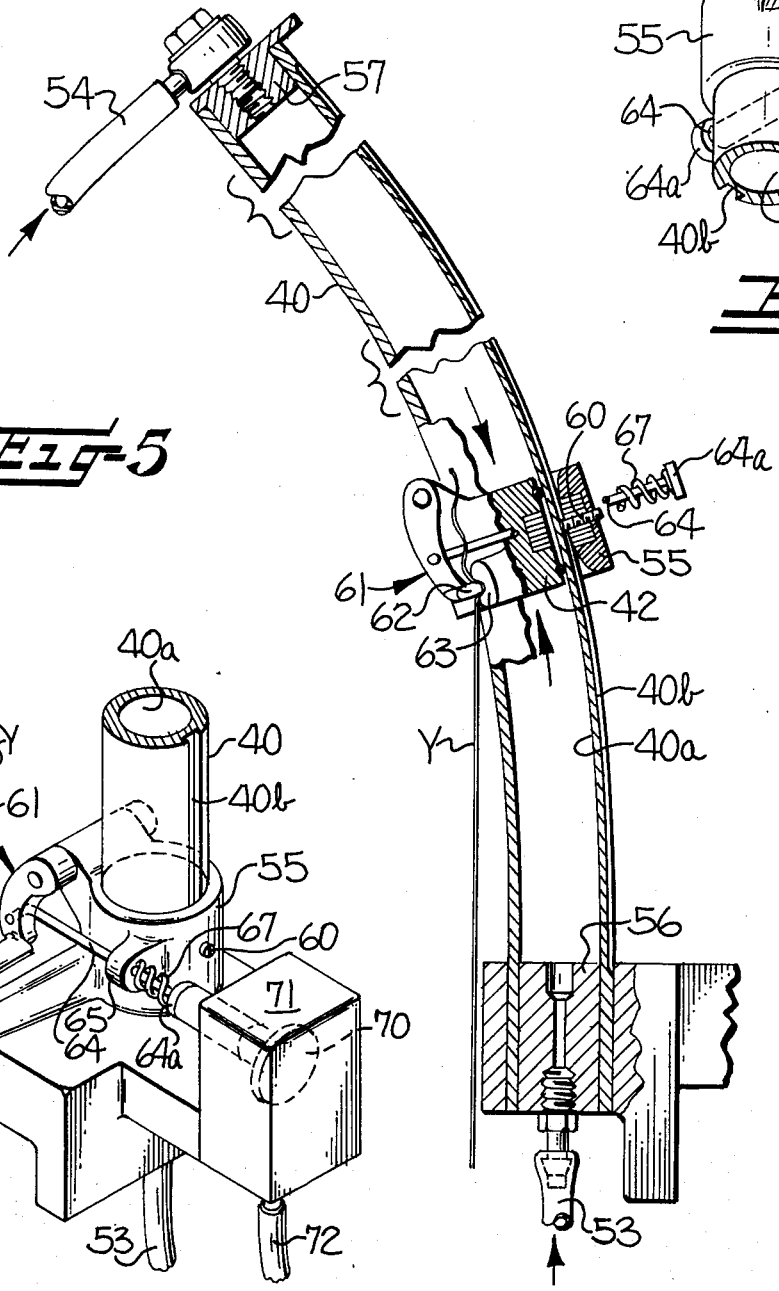
FIG. 5 is an enlarged, partial, cross-sectional, elevational view of the mechanism of this invention.

The mechanism 10 further includes a freely slideable, ring-like member 55 positioned at least partially around the outside of the tube 40 for movement on the tube along the length thereof. The ring-like member 55 is magnetically coupled through the tube 40 to the piston 42 for movement of the ring-like member 55 with the piston 42 during its travel from one end of the tube 40 to the other. The means for magnetically coupling the piston 42 and the ring-like member 55 may include any suitable magnetic means, such as permanent magnets 58 and 59 (shown particularly in FIG. 5). The ring-like member 55 is restrained from rotation around the circumference of the tube 40 by any suitable means, such as a groove **40*b* formed in the outside of the tube 40 and a pin 60 extending inwardly from the inside surface of the ring-like member 55 and received within the groove 40b of the tube 40.**

The ring-like member 55 may be a complete ring around the outside of the tube 40, as illustrated in the drawings, or may be a partial ring having a gap therein in the event that supports are utilized for supporting the tube 40 so that the ring-like member 55 may pass over the supports.

Figure 7:
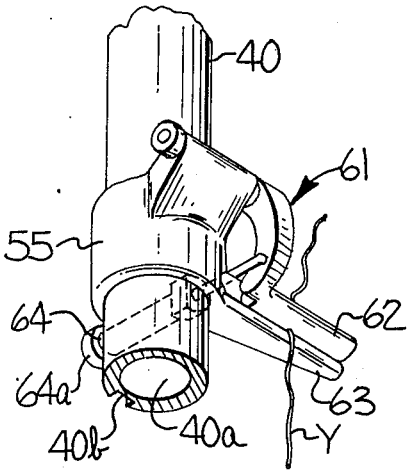
FIG. 7 is a partial, perspective view of the ringlike member and gripper means of the mechanism of this invention and illustrating the gripper means in its closed position.
Figure 6:
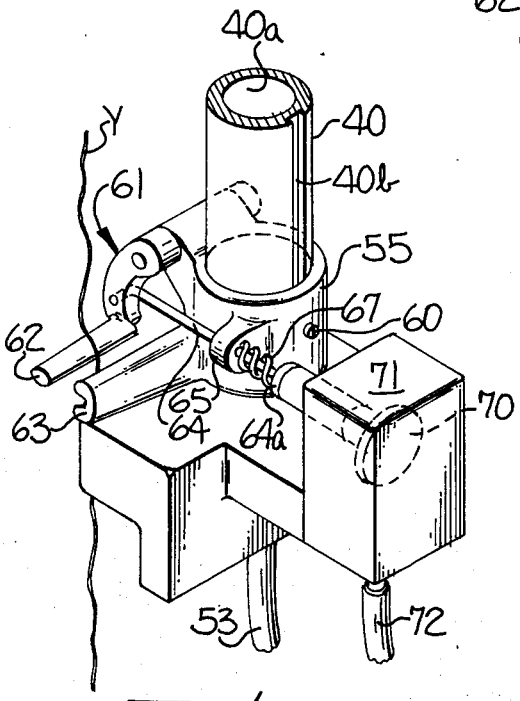
FIG. 6 is an enlarged, partial, perspective view of the ring-like member and gripper means of the mechanism of this invention and illustrating the gripper means in its open position at one end of the tube.
Figure 8:
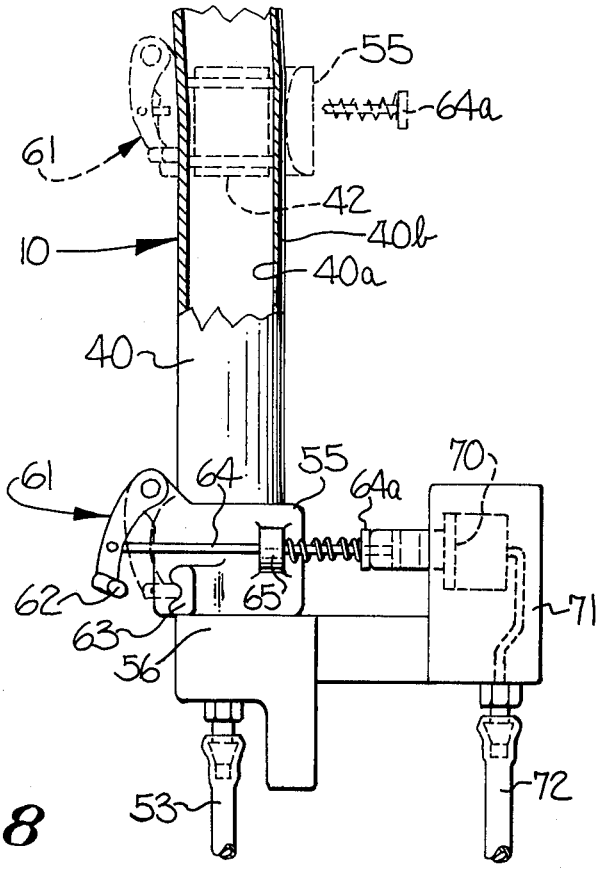
FIG. 8 is an elevational view, partly in section, of generally the bottom end of the mechanism of this invention and illustrating the ring-like member and gripper means in position at the bottom end of the tube.
Figure 9:
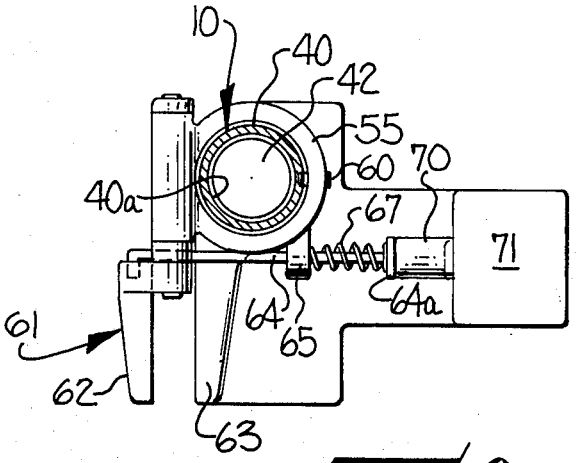
FIG. 9 is a cross-sectional plan view, taken generally along the line 9—9 of FIG. 8.

The mechanism 10 further includes a gripper means 61 carried by the ring-like member 55 for holding the yarn end Y during selective movement by the pneumatic means of the piston 42 and the ring-like member 55 along the tube 40 for transporting the yarn end Y along the predetermined desired path of travel. This gripper means may be in the form of a positive gripper, a thread comb, or the like. Preferably, the gripper means 61 comprises a pincer-type gripper having a movable jaw member 62 pivotally mounted on an upstanding portion of the ring-like member 55 for movement toward and away from a fixed jaw member 63 for gripping the yarn end Y therebetween when the jaws 62, 63 are in closed position (illustrated in FIG. 7). For opening and closing of the jaws 62, 63, there is provided a depressable plunger 64 which is fixed at one end to the movable jaw member 62, passes through a fixed collar 65 on the ring-like member 55 and has a button type outer end 64a for moving the lever to open and close the jaws 62, 63. The jaws 62, 63 are biased into a closed position by a compression spring 67 extending between the collar 65 and the outer end **64*a* of the depressable plunger 64.**

The mechanism 10 may further include selectively operable actuating means positioned adjacent one or both ends of the tube 40 for selectively operating the jaws 62, 63 of the gripper device 61 when the gripper device 61 is positioned at one or both ends of the tube 40. The actuating means may be a pneumatic or electro-magnetically operated device.

As illustrated in the embodiment of FIG. 1, there is provided a pneumatically operated actuating means in the form of a piston and cylinder mechanism 70, 71. The cylinder 71 is shown as a casing or housing mounted on the yarn processing machine frame and receiving compressed air from an air conduit 72 which may be connected in the air circuit of FIG. 2 to provide compressed air from the air source 50 through a manually depressable valve 73. Thus, when the ring-like member 55 is in either the lower or upper position thereof (illustrated in FIG. 1), the depressable plunger 64 will be in alignment with the piston 70 of piston and cylinder mechanism 70, 71 and compressed air may be selectively supplied to the piston and cylinder 70, 71 by actuating the manually depressable valve 73 which causes the piston 70 to extend and move the depressable plunger mechanism 64 to open the movable jaw 62 and allow receipt of the yarn end Y between the jaws 62, 63 of the gripper mechanism 61. Upon deactuation of the piston and cylinder mechanism 70, 71 or movement of the ring-like member 55 away from its lower or upper position, the movable jaw 62 will move back into engagement with the fixed jaw 63 to clamp or grip the yarn end Y therebetween under the influence of biasing spring 67. As shown in FIGS. 1 and 2, the pneumatically operated actuating means for selectively operating the gripper device 61 is located at both the upper and lower ends of the tube 40. However, it may be desirable to eliminate one of these pneumatically operated actuating means and rely upon the operator to manually depress the plunger 64 for opening and closing of the jaws 62, 63 of the gripper device 61 in one of the upper or lower positions.

Thus, with the mechanism 10 of this invention, as described above, fixed in position, as shown in FIG. 1, at each of the spindle assembly stations of the two-for-one twister textile yarn processing machine, operation thereof may occur, as follows.

If the yarn Y being processed by the two-for-one twister textile yarn processing machine becomes broken during the yarn processing or if a wound package of yarn is doffed from the take-up roll mechanism 24 and start-up of a new package of yarn is desired, the yarn Y will be threaded through the carrier mechanism 16 and the rotor mechanism 13 and up between the basket device 17 and the balloon limitor 21. This threading may be accomplished manually or by use of compressed air operated threading devices in accordance with U.S. Pat. No. 3,731,478, issued May 8, 1973, and assigned to the assignee of the present invention. When the yarn end Y is located in the vicinity of the upper end of the carrier mechanism 16, it may be placed between the opened jaws 62, 63 of the gripper device 61, which has been opened by the piston-cylinder mechanism 70, 71. The jaws 62, 63 of the gripper device 61 will then be closed and compressed air may be supplied to the lower end of the tube 40 and on the bottom side of the piston 42 for movement of the piston 42, ring-like member 55 and gripper device 61 along the length of the tube 40 to the upper end of the tube 40 which carries the yarn end Y along the predetermined path of travel defined by the contour of the tube 40. At the upper end of the tube 40, the gripper device 61 may again be opened by use of a piston-cylinder mechanism 70, 71 to release the yarn end Y for threading onto the take-up roll 28. As shown in FIG. 4, the tube 40 extends from generally an upper edge of the balloon limitor 21 over the pre-take-up roll 25 and to the take-up roll 28 and laterally to one side of the take-up roll 28 so that the yarn end Y may be released in the general vicinity of one of the disc-shaped members 28*a* for clamping in the take-up roll device for the starting of a new package of processed yarn on the take-up roll 28.

As shown in FIGS. 10 and 11, the mechanism 10 of this invention may be mounted on and carried by a portable service carriage mechanism 12 which is mounted on the two-for-one twister textile yarn processing machine for movement in a generally horizontal direction along the front of the side-by-side spindle assemblies for selective positioning in front of a desired spindle assembly.

The service carriage 12 comprises a generally rectangular or square shaped frame 80 having rotatable grooved wheels 81 on the bottom thereof which rest on a running rail 82 secured to a portion of the yarn processing machine frame. The carriage mechanism 12 is supported at the upper end thereof by means of runner shoes 84 slideable within a U-shaped running rail 85 carried by the textile yarn processing machine frame or the balloon limitor device 21.

The tube 40 and pneumatically operated actuating piston-cylinder mechanisms 70, 71 are mounted on the upper end of the carriage device 12 so that the entire mechanism 10 of this invention is movable along the front of the spindle assembly stations of the two-for-one twister textile yarn processing machine for selective placement at a desired spindle assembly station. In the embodiment of FIGS. 10 and 11, there is no pneumatically operated gripper device actuating piston and cylinder 70, 71 at the upper end of tube 40 and the gripper device 61 is opened at the upper end of tube 40 by manual depression of the plunger 64 by the operator of the machine.

Thus, it may be seen, that this invention has provided a mechanism for use in any textile machine for transporting along any desired predetermined path of travel an end of a continuous yarn or the like. The mechanism is particularly useful for a two-for-one twister textile yarn processing machine and may be mounted at each spindle assembly thereof or may be carried by a movable carriage which is selectively moved to a desired spindle assembly location. The mechanism will transport a yarn end from one location to another at a very fast rate with a small mechanical output and the path of travel may be varied as desired for the particular textile machine.

In the drawings and specifications there have been set forth preferred embodiments of the invention and, although specific terms are employed, they are used in a generic and descriptive sense only and not for purposes of limitation.

What is claimed is:

1. A mechanism for use in a textile machine for transporting along a predetermined desired path of travel an end of a continuous yarn or the like, said mechanism comprising:

an elongate tube extending along and conforming to the contour of the predetermined desired path of travel of the yarn end and defining a hollow interior therewithin;

a freely displaceable piston positioned within said hollow interior of said tube for movement within said tube along the length thereof;

selectively operable pneumatic means connected with said hollow interior of said tube for selectively moving said piston from one end to the other end thereof;

a freely slideable, ring-like member positioned at least partially around the outside of said tube for movement on said tube along the length thereof;

means magnetically coupling said piston and said ring-like member through said tube for movement of said ring-like member with said piston; and gripper means carried by said ring-like member for holding the yarn end during selective movement by said pneumatic means of said piston and said ring-like member along said tube for transporting the yarn end along the predetermined desired path of travel.

2. A mechanism, as set forth in claim 1, in which said mechanism further includes means for restraining said ring-like member from rotation around the circumference of said tube while allowing free slidable movement thereof with said piston along the length of said tube.

3. A mechanism, as set forth in claim 2, in which said rotation restraining means comprises a groove formed in the outside surface of said tube and extending longitudinally thereof, and a pin extending inwardly from the inside surface of said ring-like member and being slideably received within said groove in said tube.

4. A mechanism, as set forth in claim 1, in which said selectively operable pneumatic means comprises a source of compressed air connected with at least one end of said tube for supplying compressed air to said hollow interior of said tube, and selectively operable valve means connected with said compressed air source for selectively controlling the flow of the compressed air into said hollow interior of said tube.

5. A mechanism, as set forth in claim 4, in which said source of compressed air is connected with each end of said tube for selectively supplying compressed air to said hollow interior of said tube on each side of said piston.

6. A mechanism, as set forth in claim 1, in which said selectively operable pneumatic means comprises a source of suction connected with at least one end of said tube for creating a suction within said hollow interior of said tube, and selectively operable valve means connected with said suction source for selectively controlling the suction created within said hollow interior of said tube.

7. A mechanism, as set forth in claim 6, in which said source of suction is connected with each end of said tube for selectively creating a suction within said hollow interior of said tube on each side of said piston.

8. A mechanism, as set forth in claim 1, in which said gripper means comprises a selectively operable, pincer-type gripper device for being opened when said gripper device is positioned at one end of said tube to receive the yarn end, for being closed to hold the yarn end during movement of said gripper device to the other end of said tube, and for again being opened when said gripper device is positioned at the other end of said tube to release the yarn end after the transporting thereof.

9. A mechanism, as set forth in claim 8, in which said selectively operable pincer-type, gripper device includes means normally biasing said gripper device in the closed position thereof, and means for opening said gripper device against the bias of said biasing means.

10. A mechanism, as set forth in claim 9, in which said biasing means comprises a spring device and said means for opening said gripper device against the bias of said spring device comprises a depressable plunger device.

11. A mechanism, as set forth in claim 9, in which said mechanism further includes selectively operable actuating means positioned adjacent at least one end of said tube for selectively operating said gripper device opening means when said gripper device is positioned at said at least one end of said tube.

12. A mechanism, as set forth in claim 11, in which said mechanism includes said selectively operable actuating means positioned adjacent each end of said tube for selectively operating said gripper device opening means upon the positioning of said gripper device at each end of the said tube.

13. A mechanism, as set forth in claim 11, in which said actuating means comprises a selectively operable, pneumatically operated, actuating means.

14. In a textile yarn processing machine, such as a twister, spinning frame or the like, having a plurality of side-by-side spindle assemblies for the processing of yarn and each of which includes a carrier mechanism for supporting a supply package of yarn to be withdrawn and processed and a takeup roll mechanism for the winding of the yarn after processing and being positioned above said carrier mechanism; the combination therewith of a mechanism for receiving an end of the continuous yarn being processed at the vicinity of said carrier mechanism, for transporting the yarn end along a predetermined desired path of travel and for positioning the yarn end at the vicinity of said take-up roll mechanism to facilitate yarn piecing or start-up of the yarn processing operation, said mechanism comprising an elongate tube carried by said yarn processing machine adjacent each of said spindle assemblies and extending along and conforming to the contour of the predetermined desired path of travel of the yarn end from said carrier mechanism to said take-up roll mechanism and defining a hollow interior therewithin, a freely displaceable piston positioned within said hollow interior of said tube for movement within said tube along the length thereof, selectively operable pneumatic means connected with said hollow interior of said tube for selectively moving said piston from one end to the other end thereof, a freely slideable, ring-like member positioned at least partially around the outside of said tube for movement on said tube along the length thereof, means magnetically coupling said piston and said ring-like member through said tube for movement of said ring-like member with said piston, and gripper means carried by said ring-like member for holding the yarn end during selective movement by said pneumatic means of said piston and said ring-like member along said tube transporting the yarn end along the predetermined desired path of travel.

15. In a textile yarn processing machine, as set forth in claim 14, in which said mechanism further includes means for restraining said ring-like member from rotation around the circumference of said tube while allowing free slideable movement thereof with said piston along the length of said tube and comprising a groove formed in the outside surface of said tube and extending longitudinally thereof and a pin extending inwardly from the inside surface of said ring-like member and being slideably received within said groove in said tube.

16. In a textile yarn processing machine, as set forth in claim 14, in which said selectively operable pneumatic means comprises a source of compressed air connected with at least the bottom end of said tube for supplying compressed air to said hollow interior of said tube, and selectively operable valve means connected with said compressed air source for selectively controlling the flow of compressed air into said hollow interior of said tube.

17. In a textile yarn processing machine, as set forth in claim 14, in which said selectively operable pneumatic means comprises a source of suction connected with at least the upper end of said tube for creating a suction within said hollow interior of said tube, and selectively operable valve means connected with said suction source for selectively controlling the suction created within said hollow interior of said tube.

18. In a textile yarn processing machine, as set forth in claim 14, in which said gripper means comprises a selectively operable, pincer-type, gripper device for being opened when said gripper device is positioned at the one end of said tube in the vicinity of said carrier mechanism to receive the yarn end, for being closed to hold the yarn end during movement of said gripper device to the other end of said tube in the vicinity of said take-up roll mechanism, and for again being opened when said gripper device is positioned at the other end of said tube to release the yarn end after the transporting thereof.

19. In a textile yarn processing machine, as set forth in claim 18, in which said selectively operable, pincer-type, gripper device includes means normally biasing said gripper device in the closed position thereof, and means for opening said gripper device against the bias of said biasing means.

20. In a textile yarn processing machine, as set forth in claim 19, in which said mechanism includes selectively operable, pneumatically operated, actuating means positioned adjacent each end of said tube for selectively operating said gripper device opening means upon the positioning of said gripper device at each end of said tube.

21. In a textile yarn processing machine, as set forth in claim 14, in which said textile yarn processing machine comprises a two-for-one twister, said carrier mechanism includes a balloon limitor device extending generally around the outside of said carrier mechanism and the supply package supported thereby, said take-up roll mechanism includes a pre-take-up roll and a take-up roll positioned generally above said pre-take-up roll, and said tube extends from generally an upper edge of said balloon limitor over said pre-take-up roll and to said take-up roll and laterally to one side of said take-up roll in an upwardly extending, laterally curved, contour.

22. In a textile yarn processing machine, such as a twister, spinning frame or the like, having a plurality of side-by-side spindle assemblies for the processing of yarn and each of which includes a carrier mechanism for supporting a supply package of yarn to be withdrawn and processed and a takeup roll mechanism for winding of the yarn after processing and being positioned above said carrier mechanism; the combination therewith of a mechanism for receiving an end of the continuous yarn being processed at the vicinity of said carrier mechanism, for transporting the yarn end along a predetermined desired path of travel and for positioning the yarn end at the vicinity of said take-up roll mechanism, to facilitate yarn piecing or start-up of the yarn processing operation, said mechanism comprising:

a portable carriage mechanism mounted on said yarn processing machine for movement in generally a horizontal direction along the front of said side-by-side spindle assemblies for selective positioning in front of a desired spindle assembly;

an elongate tube carried by said carriage mechanism and extending upwardly therefrom and conforming generally to the contour of the predetermined desired path of travel of the yarn end from said carrier mechanism to said take-up roll mechanism and defining a hollow interior therewithin;

a freely displaceable piston positioned within said hollow interior of said tube for movement within said tube along the length thereof;

selectively operable pneumatic means connected with said hollow interior of said tube for selectively moving said piston from one end to the other end thereof;

a freely slideable, ring-like member positioned at least partially around the outside of said tube for movement on said tube along the length thereof;

means magnetically coupling said piston and said ring-like member through said tube for movement of said ring-like member with said piston; and gripper means carried by said ring-like member for holding and carrying the yarn end during selective movement by said pneumatic means of said piston and said ring-like member along said tube for transporting the yarn end along the predetermined desired path of travel from said carrier mechanism to said take-up mechanism.

23. In a textile yarn processing machine, as set forth in claim 22, in which said mechanism further includes means for restraining said ring-like member from rotation around the circumference of said tube while allowing free slideable movement thereof with said piston along the length of said tube.

24. In a textile yarn processing machine, as set forth in claim 22, in which said selectively operable pneumatic means comprises a source of compressed air connected with each end of said tube for selectively supplying compressed air to said hollow interior of said tube on each side of said piston, and selectively operable valve means connected with said compressed air source for selectively controlling the flow of compressed air into each end of said hollow interior of said tube.

25. In a textile yarn processing machine, as set forth in claim 22, in which said selectively operable pneumatic means comprises a source of suction connected with each end of said tube for selectively creating a suction within said hollow interior of said tube on each side of said piston, and selectively operable valve means connected with said suction source for selectively controlling the suction created within said hollow interior of said tube on each side of said piston.

26. In a textile yarn processing machine, as set forth in claim 22, in which said gripper means comprises a selectively operable, pincer-type, gripper device for being opened when said gripper device is positioned at one end of said tube to receive the yarn end, for being closed to hold the yarn end during movement of said gripper device to the other end of said tube, and for again being opened when said gripper device is positioned at the other end of said tube to release the yarn after the transporting thereof.

27. In a textile yarn processing machine, as set forth in claim 26, in which said selectively operable, pincer-type gripper device includes means normally biasing said gripper device in the closed position thereof, and depressable plunger means for opening said gripper device against the bias of said biasing means.

28. In a textile yarn processing machine, as set forth in claim 27, in which said mechanism further includes selectively operable, pneumatically operated, actuating means positioned adjacent the bottom end of said tube for selectively operating said gripper device opening means when said gripper device is positioned at the bottom end of said tube.

* * * * *